US008171854B2

(12) United States Patent
Heitmann et al.

(10) Patent No.: US 8,171,854 B2
(45) Date of Patent: May 8, 2012

(54) CARTRIDGE

(75) Inventors: Thomas Heitmann, Unterlüß (DE); Christian Baumann, Martinsrieth (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 0 days.

(21) Appl. No.: 12/709,411

(22) Filed: Feb. 19, 2010

(65) Prior Publication Data

US 2010/0236441 A1 Sep. 23, 2010

(30) Foreign Application Priority Data

Feb. 20, 2009 (DE) ..... 10 2009 009 776

(51) Int. Cl.
*F42B 14/06* (2006.01)

(52) U.S. Cl. ..... 102/523; 102/520

(58) Field of Classification Search ..... 102/520, 102/521, 522, 523, 439
See application file for complete search history.

(56) References Cited

U.S. PATENT DOCUMENTS

| | | | | |
|---|---|---|---|---|
| 3,620,167 | A | 11/1971 | Romer et al. | |
| 4,140,061 | A | 2/1979 | Campoli | |
| 4,195,573 | A | 4/1980 | Leeker et al. | |
| 4,362,107 | A * | 12/1982 | Romer et al. | 102/520 |
| 4,444,113 | A | 4/1984 | Campoli | |
| 4,450,770 | A | 5/1984 | Kirkendall et al. | |
| 5,063,855 | A | 11/1991 | Diel et al. | |
| 6,019,217 | A * | 2/2000 | Melan et al. | 206/3 |
| 6,854,394 | B2 * | 2/2005 | Henry et al. | 102/521 |
| 7,152,533 | B2 * | 12/2006 | Eches et al. | 102/521 |
| 7,197,984 | B2 * | 4/2007 | Eches | 102/521 |
| 7,503,262 | B2 * | 3/2009 | Eches et al. | 102/521 |
| 7,594,472 | B1 * | 9/2009 | Parratt et al. | 102/520 |
| 7,934,456 | B1 * | 5/2011 | Heitmann et al. | 102/522 |

FOREIGN PATENT DOCUMENTS

| | | |
|---|---|---|
| DE | 1703507 A | 3/1972 |
| DE | 27 47 313 C2 | 1/1983 |
| DE | 39 37 665 A1 | 5/1991 |

OTHER PUBLICATIONS

"formschlüssig, kraftschlüssig> form-fit[ted], force-fit[ted]," at http://www.proz.com/kudoz/german_to_english/engineering_genera..., downloaded Sep. 13, 2011, three pages, which is filed herewith as "Exhibit A."

(Continued)

*Primary Examiner* — James Bergin
(74) *Attorney, Agent, or Firm* — Griffin & Szipl, P.C.

(57) ABSTRACT

A cartridge (1) is provided comprising a cartridge case (2) and a projectile arrangement (3; 3') with an arrow projectile (5; 5') with a sub-caliber control unit (7), wherein the projectile arrangement (3; 3') is connected to the cartridge case (2) via a case cover (4), wherein, after firing of the projectile arrangement (3; 3'), a precise guiding of the arrow projectile (5; 5') in the corresponding weapon barrel is ensured due to a receptacle device (28; 28') that centers the control unit (7) of the arrow projectile (5; 5'), and that can be separated from the control unit (7) when the projectile arrangement (3; 3') is fired. The receptacle device is connected to the case cover (4) on the projectile side, wherein the receptacle device grasps a ring-shaped rear flange (29; 29') whose outer diameter corresponds to the projectile caliber of the respective cartridge (1).

17 Claims, 3 Drawing Sheets

OTHER PUBLICATIONS

"Verbindungstechnik," at http://de.wikipedia.org/wiki/Verbindungstechnik, downloaded Sep. 13, 2011, three pages, which is filed herewith as "Exhibit B."

English translation of "Exhibit B" above obtained from translate.googleusercontent.com, which is filed herewith at "Exhibit C."

Online German-to-English dictionary, available at http://dict.tu-chemnitz.de/deutsch-englisch/Formschluss.html, downloaded Sep. 13, 2011, one page, which is filed herewith as "Exhibit D."

Online German-to-English dictionary, available at http://dict.tu-chemnitz.de/dings.cgi?lang=en&service=deen&opterrors=0&query=Kraftschluss&iservice=&comment=&email=, downloaded Sep. 13, 2011, one page, which is filed herewith as "Exhibit E."

"Formschluss" at http://smerobot-tools.prospektiv.de/glossar/deu/formschluss.html, downloaded Sep. 13, 2011, one page, which is filed herewith as "Exhibit F."

English translation of "Exhibit F" above obtained from translate.googleusercontent.com, which is filed herewith as "Exhibit G."

Webpage available at http://www.lasiportal.de/ladungssicherung/grundwissen/arten-der-lasi/kraftschluss/kraftschluessige-sicherung-und-sicherung-durch-reibschluss.php, two pages, which is filed herewith as "Exhibit H."

English translation of "Exhibit H" above obtained from translate.googleusercontent.com, which is filed herewith as "Exhibit I."

"Kraftschluss," at http://www.proz.com/kudoz/german_to_english/engineering%3A_industria1/1643678-kraftschluss.html, downloaded Sep. 13, 2011, three pages, which is filed herewith as "Exhibit J."

"Formschluss > form mating," at http://www.proz.com/?sp=gloss/term&id=1739480, downloaded Sep. 13, 2011, one page, which is filed herewith as "Exhibit K."

"Reibschluss" at http://145.253.206.136/bosch/wbt_stein/content/technologien/befestigungstechnik/reibschluss/index_ger.html?html_b=1, downloaded Sep. 13, 2011, one page, which is filed herewith at "Exhibit L"

Notice of Allowance issued in co-pending realted U.S. Appl. No. 12/709,431 on Feb. 7, 2012.

* cited by examiner

CARTRIDGE

This application claims priority from German Patent Application No. DE 10 2009 009 776.7, filed Feb. 20, 2009, the entire disclosure of which is incorporated herein by reference.

FIELD OF THE INVENTION

The invention relates to a cartridge that comprises a cartridge case and a projectile arrangement that is connected to the cartridge case via a case cover.

BACKGROUND OF THE INVENTION

A cartridge of this type is known for example from DE 27 47 313 C2. The known projectile arrangement thereby comprises an arrow projectile with a sub-caliber projectile body and a cone control unit arranged on the projectile body at the rear, wherein a one-flange sabot cage segmented with the arrow projectile and having wall areas extending outwards is connected in a non-positive and/or positive manner between the center of gravity of the projectile body and the projectile tip.

In order to obtain a good centering of the entire projectile in the weapon barrel during use of a one-flange sabot cage of this type, in DE 27 47 313 C2, the use of a same-caliber cone control unit is proposed so that the projectile can support itself in the weapon barrel at the rear via the control unit at the inner wall of the weapon barrel. However, such projectiles have the disadvantage that the cone control units, in particular when they are to be fired from large-caliber weapons, are very cost-intensive and have a high weight.

In so far as arrow projectiles provided with a sub-caliber control unit are to be used, DE 27 47 313 C2 proposes the use of two-flange sabot cages, as are known for example from DE-PS 17 03 507. However, such sabot cages likewise have a high weight and are very cost-intensive.

Cartridges are known from DE 39 37 665 A 1, whose projectile arrangements comprise arrow projectiles with sub-caliber control units as well as one-flange sabot cages. Several additional support struts, which are arranged uniformly distributed over the circumference of the rearward end areas of the sabot cages, thereby serve for centering and supporting the projectile arrangements in the respective weapon barrel.

The object of the invention is to provide a cartridge of the type mentioned at the outset whose projectile arrangement can be produced more cost-effectively than comparable arrangements.

SUMMARY OF THE INVENTION

This object of the invention is achieved according to a first embodiment of the invention through the features of a cartridge comprising a cartridge case (2) and a projectile arrangement (3; 3') that is connected to the cartridge case (2) via a case cover (4), with the features wherein: (a) the projectile arrangement (3; 3') includes an arrow projectile (5; 5') with a sub-caliber projectile body (6; 6') and a sub-caliber control unit (7) arranged on the projectile body (6; 6') at the rear; (b) between the center of gravity (8, 8') of the projectile body (6; 6') and the projectile tip (9) of the arrow projectile (5; 5'), a segmented one-flange sabot cage (10; 10') with radial wall areas (15) extending outwards is connected non-positively and/or positively to the projectile body (6; 6'); (c) a receptacle device (28; 28') that centers the control unit (7) of the arrow projectile (5; 5') and that can be separated from the control unit (7) when the cartridge (1) is fired, is connected to the case cover (4) on the projectile side, which receptacle device grasps a ring-shaped rear flange (29; 29') whose outer diameter corresponds to the projectile caliber of the respective cartridge (1). Particularly advantageous embodiments of the invention include additional features.

For example, in accordance with a second embodiment of the invention, the first embodiment is further modified so that the receptacle device (28; 28') is made of plastic. In accordance with a third embodiment of the present invention, the first embodiment or the second embodiment is further modified so that it is provided with an arrow projectile (5; 5') with cone control unit (7), and the receptacle device (28; 28') has a cone-shaped front part (30; 30') grasping the control unit (7), which front part is arranged in front of the rear flange (29; 29') on the sabot cage side and bears against the control unit (7) positively at least in a partial area of the control unit (7). In accordance with a fourth embodiment of the invention, the third embodiment is further modified so that the outside of the cone-shaped front part (30') of the receptacle device (28') is connected to the rear flange (29') via several rib-shaped struts (32) arranged distributed uniformly over the circumference.

In accordance with a fifth embodiment of the invention, the first embodiment, the second embodiment, the third embodiment, and the fourth embodiment are further modified so that the one-flange sabot cage (10; 10') has a cone-shaped rear part (16) adjacent at the rear to the radial wall areas (15), and the rear end (17) of which rear part is arranged at the projectile tip side in front of the center of gravity (8) of the arrow projectile (5; 5'). In accordance with a sixth embodiment of the present invention, the first embodiment, the second embodiment, the third embodiment, the fourth embodiment, and the fifth embodiment are further modified so that the sabot cage segments (12-14) of the one-flange sabot cage (10; 10') are made of steel. In accordance with a seventh embodiment of the invention, the first embodiment, the second embodiment, the third embodiment, the fourth embodiment, the fifth embodiment and the sixth embodiment are further modified so that the separating lines (18-20) formed between the sabot cage segments (12-14) are sealed gas-tight through a rubber layer (21) at least at the rear side.

In accordance with an eighth embodiment of the invention, the first embodiment, the second embodiment, the third embodiment, the fourth embodiment, the fifth embodiment, the sixth embodiment, and the seventh embodiment are further modified so that the radial wall area (15) of the sabot cage (10; 10') is provided with a sealing lip (22) at its end facing away from the arrow projectile (5; 5'). In accordance with an ninth embodiment of the invention, the eighth embodiment is further modified so that the sealing lip (22) is made of rubber. In accordance with a tenth embodiment of the present invention, the first embodiment, the second embodiment, the third embodiment, the fourth embodiment, the fifth embodiment, the sixth embodiment, the seventh embodiment, the eighth embodiment and the ninth embodiment are further modified so that the radial wall area (15) of the sabot cage (10; 10') is provided on its outside with a recess (23) in which a segment ring (24) having a wedge-shaped area at the front, and having a spacing corresponding to the segmented sabot cage (10; 10'), is inserted on the front side and a surrounding guiding- and sealing band (25) adjacent to the segment ring (24) is inserted at the rear, which band covers at least the wedge-shaped area of the segment ring (24) facing it, wherein the segment ring (24) and the guiding- and sealing band (25) are selected such that in the rest position of the projectile arrangement (3; 3'), the outer diameter of the guiding- and sealing band (25) is less than, or the same as, the projectile caliber and when the projectile arrangement (3; 3') is fired, the wedge-shaped area of the segment ring (24) presses the guiding- and sealing band (25) outwards.

In accordance with an eleventh embodiment of the invention, the tenth embodiment is further modified so that the segment ring (24) is made of metal and the guiding- and sealing band (25) is made of plastic. In accordance with a twelfth embodiment of the invention, the first embodiment, the second embodiment, the third embodiment, the fourth embodiment, the fifth embodiment, the sixth embodiment, the seventh embodiment, the eighth embodiment, the ninth embodiment, the tenth embodiment and the eleventh embodiment are further modified so that the radial wall area (15) of the sabot cage (10; 10') is provided with pocket-shaped depressions (26, 27) at both the front and the rear. In accordance with a thirteenth embodiment of the invention, the first embodiment, the second embodiment, the third embodiment, the fourth embodiment, the fifth embodiment, the sixth embodiment, the seventh embodiment, the eighth embodiment, the ninth embodiment, the tenth embodiment, the eleventh embodiment and the twelfth embodiment are further modified so that the sabot cage (10; 10') is composed of three identical sabot cage segments (12-14).

The invention is based essentially on the concept of connecting to the case cover on the projectile side, a receptacle device that centers the control unit of the arrow projectile and can be separated from the control unit when the cartridge is fired, which receptacle device includes a ring-shaped rear flange whose outer diameter corresponds to the projectile caliber of the respective cartridge. Preferably, the receptacle device is made of plastic.

In another preferred form of embodiment of the invention, in which the arrow projectile has a cone control unit, the receptacle device has a cone-shaped front part enclosing the control unit, which front part is arranged in front of the rear flange on the sabot cage side and bears positively against the control unit at least in a partial area of the unit. The outside of the cone-shaped front part of the receptacle device can thereby be connected to the rear flange via several rib-shaped struts arranged and distributed uniformly over the circumference.

The one-flange sabot cage can preferably have, as gas pressure absorption surfaces, a cone-shaped rear part adjacent at the rear to the radial wall areas, the rear-side end of which rear part, however, is still arranged in front of the center of gravity of the arrow projectile. The sabot cage segments can be made of steel or a light metal. The separating lines formed between the sabot cage segments are preferably sealed gas-tight through a rubber layer at the rear.

In order to ensure that propelling charge gases do not flow past the projectile arrangement at the barrel wall during movement of the projectile arrangement after firing, it has proved to be advantageous if the radial wall area of the sabot cage is provided at its end facing away from the arrow projectile with a sealing lip, preferably made of rubber, at the rear. Moreover, in order to be able to load the cartridge without the guiding- and sealing band usually fixed to the sabot cage at the outer circumference hindering the loading process, the radial wall areas of the sabot cage are provided on their outer side with a recess, in which at the front side a wedge-shaped segment ring with a spacing corresponding to the segmented sabot cage is inserted, and at the rear side a surrounding guiding- and sealing band is inserted adjacent to the segment ring, wherein the guiding- and sealing band covers at least the wedge-shaped area of the segment ring facing towards it, and wherein the segment ring and the guiding- and sealing band are selected such that in the rest position of the projectile arrangement, the outer diameter of the guiding- and sealing band is less than, or the same as, the projectile caliber and when the projectile arrangement is fired, the wedge-shaped area of the segment ring presses the guiding- and sealing band outwards. The segment ring can thereby be made of metal and the guiding- and sealing band can be made of a suitable plastic.

It has proved to be advantageous if the radial wall areas of the sabot cage are provided with pocket-shaped depressions, both at the front and the rear, so that the sabot cage segments lift radially away from the projectile body approximately parallel to it due to the dynamic air pressure forces acting on them at the front and the propelling charge gas forces at the rear, when the projectile arrangement has passed the corresponding weapon barrel at the muzzle.

With the present design, it is ensured that after firing, a precise guiding of the arrow projectile is realized in the corresponding weapon barrel. In addition to the cost aspect, the problem of the weight aspects is also taken into consideration, and the interface. for example for a 120 mm ammunition, is taken into account. The control unit and projectile body can comprise two parts, but can also be produced from one part. For the material selection, in addition to the forces during firing, the position of the center of gravity of the flight projectile must be taken into consideration. Thus, for example, due to its light weight a control unit of (light) aluminum reduces the tensile stress in the transferring cross section of the projectile body, but shifts the center of gravity of the flight projectile further forwards.

BRIEF DESCRIPTION OF THE DRAWINGS

Other details and advantages of the invention are revealed by the following exemplary embodiments explained based on the Figures. They include.

DETAILED DESCRIPTION OF THE INVENTION

Figure 1:
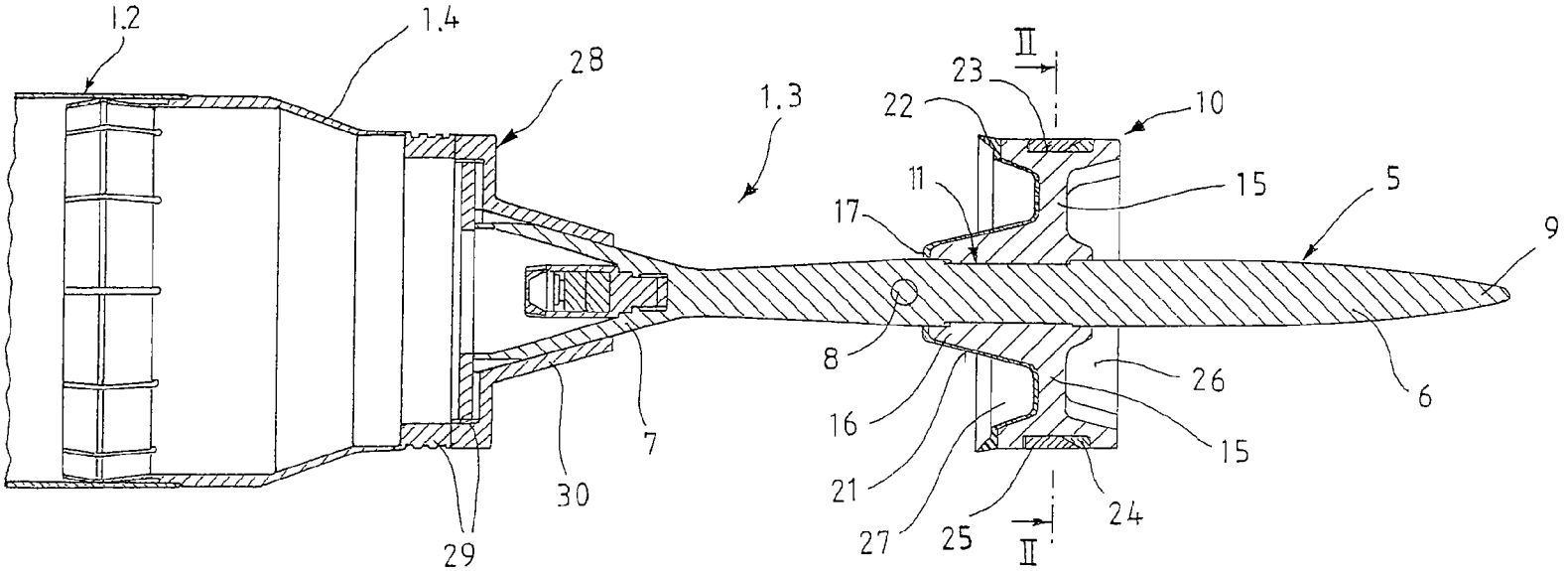
FIG. 1, which shows the cross section through a first exemplary embodiment of a cartridge according to the invention in the area of its projectile arrangement.

In FIG. 1, 1 designates a cartridge that comprises essentially a cartridge case 2 and a projectile arrangement 3, which is connected to the cartridge case 2 via a case cover 4. In FIG. 1, only the end section of the cartridge case 2, which faces the case cover 4, is shown thereby. The projectile arrangement 3 includes an arrow projectile 5 provided with a sub-caliber projectile body 6, and a sub-caliber cone control unit 7 arranged on the projectile body 6 at the rear. The arrow projectile 5 shown in the drawings is a practice projectile whose projectile body 6 is made of steel, and whose control unit 7 is made of an aluminum alloy, for example.

Figure 2:
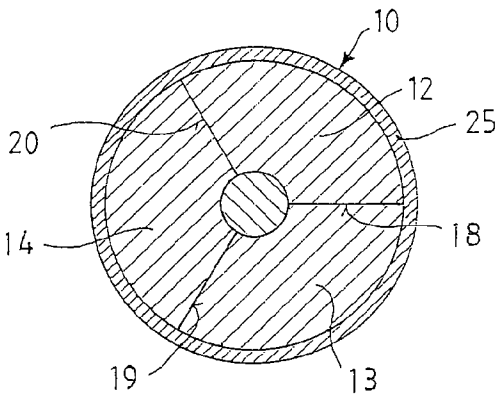
FIG. 2 shows a cross section along the line of cut designated II-II in FIG. 1.

Between the center of gravity, designated as 8, of the projectile body 6 and the projectile tip 9 of the arrow projectile 5, a one-flange sabot cage 10 segmented through longitudinal spacing is attached, wherein the force transfer between the sabot cage 10 and the projectile body 6 takes place non-positively by means of a cone seat 11. The one-flange sabot cage 10 comprises three identical sabot cage segments 12-14 (FIG. 2), which respectively describe an angle of 120° in the circumferential direction and are preferably made of steel. The one-flange sabot cage 10 has a radial wall area 15 extending outwards, via which wall area the arrow projectile 5 is supported on the inner surface of a corresponding weapon barrel (not shown). A cone-shaped rear part 16, whose rear end 17 is likewise still arranged in front of the center of gravity 8 of the arrow projectile 5, is adjacent to the radial wall area 15 at the rear. The separating lines 18-20 formed at the rear, between the sabot cage segments 12-14 (FIG. 2), are sealed gas-tight through a rubber layer 21 (FIG. 1).

Moreover, the radial wall area 15 of the sabot cage 10 at its radial end facing away from the arrow projectile 5 is provided, at the rear, with a surrounding sealing lip 22 made of rubber in order to ensure that when the projectile arrangement 3 is fired in the corresponding weapon barrel, no propelling charge gases flow through between the inner surface of the weapon barrel and the weapon barrel end of the radial wall area 15 of the sabot cage 10. Moreover, the radial wall area 15 of the sabot cage 10 is provided on the outside with a recess 23, in which a wedge-shaped segment ring 24 made of metal and having a spacing corresponding to the segmented sabot cage 10, is inserted on the front side, and a surrounding guiding- and sealing band 25 made of plastic is inserted on the rear side, which band covers the wedge-shaped segment ring 24 at least at the rear side. The segment ring 24 and the guiding- and sealing band 25 are selected thereby in such a way that, in the rest position of the projectile arrangement 3 shown in FIG. 1, the outer diameter of the guiding- and sealing band 25 is smaller than, or the same as, the projectile caliber. This ensures that the guiding- and sealing band 25 does not obstruct the loading or unloading process of the cartridge 1.

However, during the firing of the cartridge 1, the segments of the segment ring 24, with its wedge-shaped ends facing towards the guiding- and sealing band 25, are accelerated axially in the direction of the control unit 7, and the guiding- and sealing band 25 expands so that in addition to the initial obturation ensured through the sealing lip 22, a further sealing against propelling charge gases flowing along the inner surface of the corresponding weapon barrel takes place. The radial wall area 15 of the sabot cage 10 has pocket-shaped depressions 26, 27, both at the front and the rear, so that through the dynamic air pressures acting on the cartridge at the front and also the propelling charge gas forces acting on it at the rear, when the cartridge is fired, the sabot cage segments 12-14 lift away radially from the projectile body 6 approximately parallel to it, when the projectile arrangement 3 has passed the muzzle of the corresponding weapon barrel.

At the projectile side, a receptacle device 28 that centers the control unit 7 of the arrow projectile 5, and that can be separated from the control unit 7 when the cartridge 1 is fired, is connected to the case cover 4 of the cartridge 1. The receptacle device 28 is preferably made of plastic and includes a ring-shaped rear flange 29 whose outer diameter corresponds to the projectile caliber of the respective cartridge 1. A cone-shaped front part 30, which grasps the cone control unit 7 of the arrow projectile 5, is adjacent to the rear flange 29 at the sabot cage side, which front part bears positively against the control unit 7 in a partial area of the control unit 7.

Figure 3:
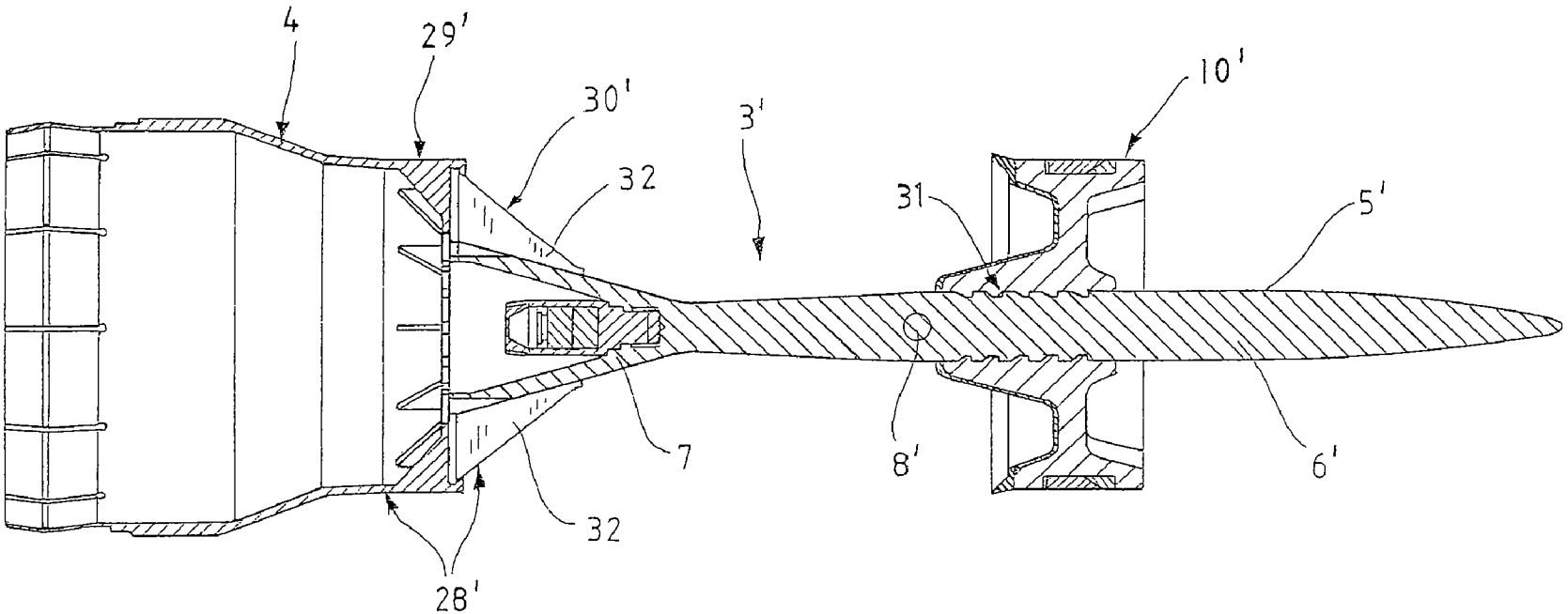
FIG. 3 shows the longitudinal section through a second exemplary embodiment of a cartridge according to the invention in the area of its projectile arrangement.
Figure 4:
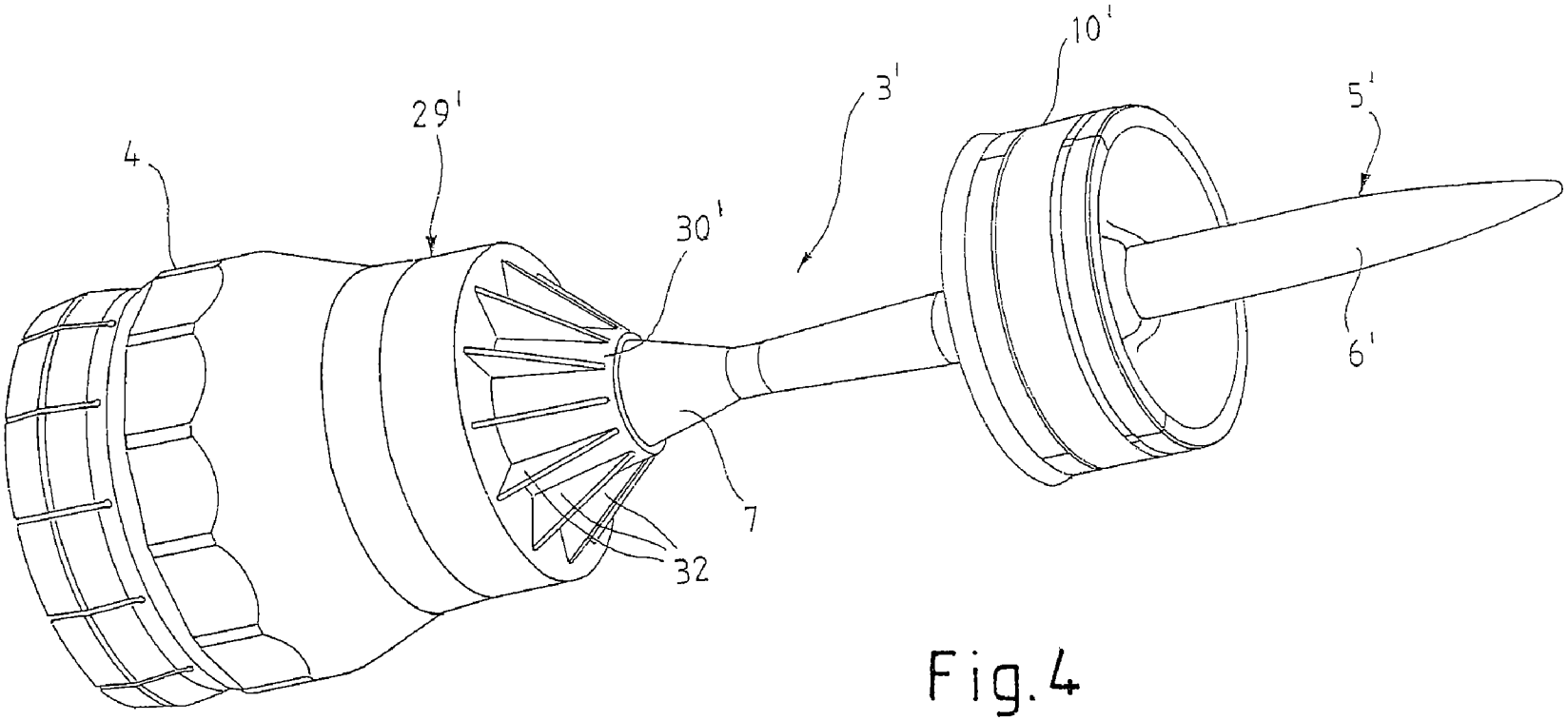
FIG. 4 is a perspective view of the projectile arrangement shown in FIG. 3 with case cover attached thereto.

Of course, the invention is not limited to the exemplary embodiment described above. Thus the one-flange sabot cage and the arrow projectile can, for example, also be connected to one another via a positive connection, such as a groove profile or a thread. FIGS. 3 and 4 show a corresponding exemplary embodiment. A projectile arrangement 3' is thereby revealed, by FIGS. 3 and 4, in which the one-flange sabot cage 10' is connected via a groove profile 31 to the projectile body 6' of the arrow projectile 5'. Moreover, in this exemplary embodiment, it is advantageously provided that the outside of the cone-shaped front part 30' of the receptacle device 28' is connected to the rear flange 29' via several rib-shaped struts 32 arranged and distributed uniformly over the circumference.

List of Reference Numbers

| | |
|---|---|
| 1 | Cartridge |
| 2 | Cartridge case |
| 3, 3' | Projectile arrangements |
| 4 | Case cover |
| 5, 5' | Arrow projectiles |
| 6, 6' | Projectile body |
| 7 | Control unit, cone control unit |
| 8, 8' | Center of gravity |
| 9 | Projectile tip |
| 10, 10' | Sabot cages, one-flange sabot cages |
| 11 | Cone seat |
| 12-14 | Sabot cage segments |
| 15 | Radial wall area |
| 16 | Rear part |
| 17 | Rear end |
| 18-20 | separating lines |
| 21 | Rubber layer |
| 22 | Sealing lip |
| 23 | Recess |
| 24 | Segment ring |
| 25 | Guiding- and sealing band |
| 26, 27 | Pocket-shaped depressions |
| 28, 28' | Receptacle devices |
| 29, 29' | Rear flange |
| 30, 30' | Front parts |
| 31 | Groove profile |
| 32 | Struts |

The invention claimed is:

1. A cartridge comprising:

(a) a cartridge case; and (b) a projectile arrangement that is connected to the cartridge case via a case cover, wherein the projectile arrangement includes i. an arrow projectile provided with a sub-caliber projectile body and a sub-caliber control unit arranged on the projectile body at a rear of the projectile body;

ii. a segmented one-flange sabot cage provided with radial wall areas extending outwards from an axis of the segmented one-flange sabot cage, wherein the segmented one-flange sabot cage is connected to the projectile body between a center of gravity of the projectile body and a projectile tip of the arrow projectile; and iii. a receptacle device disposed to center the control unit of the arrow projectile and that is separable from the control unit when the cartridge is fired, wherein the receptacle device is connected to the case cover on a projectile side of the case cover, and the receptacle device includes a ring-shaped rear flange whose outer diameter corresponds to a projectile caliber of the cartridge.

2. A cartridge according to claim 1, wherein the receptacle device is made of plastic.

3. A cartridge according to claim 2, wherein the arrow projectile is provided with the control unit and the receptacle device has a cone-shaped front part grasping the control unit, wherein the front part of the receptacle device is arranged in front of the ring-shaped rear flange on a sabot cage side and positively bears against the control unit, at least in a partial area of the control unit.

4. A cartridge according to claim 3, wherein an outside of the cone-shaped front part of the receptacle device is connected to the ring-shaped rear flange via several rib-shaped struts arranged and distributed uniformly over a circumference.

5. A cartridge according to claim 1, wherein the arrow projectile is provided with the control unit and the receptacle device has a cone-shaped front part grasping the control unit, wherein the front part of the receptacle device is arranged in front of the ring-shaped rear flange on a sabot cage side and positively bears against the control unit, at least in a partial area of the control unit.

6. A cartridge according to claim 5, wherein an outside of the cone-shaped front part of the receptacle device is connected to the ring-shaped rear flange via several rib-shaped struts arranged and distributed uniformly over a circumference.

7. A cartridge according to claim 1, wherein the one-flange sabot cage has a cone-shaped rear part adjacent, at a rear of the sabot cage, to the radial wall areas, wherein a rear end of the rear part is arranged at a projectile tip side in front of the center of gravity of the arrow projectile.

8. A cartridge according to claim 1, wherein a plurality of sabot cage segments of the segmented one-flange sabot cage are made of steel.

9. A cartridge according to claim 1, wherein separating lines formed between sabot cage segments of the segmented one-flange sabot cage are sealed gas-tight through a rubber layer at least at a rear side of the segmented one-flange sabot cage.

10. A cartridge according to claim 1, wherein the radial wall areas of the sabot cage are provided with a sealing lip at an end of the radial wall areas facing away from the arrow projectile.

11. A cartridge according to claim 10, wherein the sealing lip is made of rubber.

12. A cartridge according to claim 1, wherein the radial wall areas of the sabot cage are provided on an outside of the sabot cage with a recess in which a segment ring, having a wedge-shaped area at front and having a spacing corresponding to the segmented sabot cage, is inserted on a front side of the recess, and a surrounding guiding and sealing band disposed adjacent to the segment ring is inserted at a rear of the recess, wherein the sealing band covers at least the wedge-shaped area of the segment ring facing the band, and wherein the segment ring and the guiding and sealing band are selected so that, in a rest position of the projectile arrangement, an outer diameter of the guiding and sealing band is less than, or the same as, a projectile caliber, and when the projectile arrangement is fired, the wedge-shaped area of the segment ring presses the guiding and sealing band outwards.

13. A cartridge according to claim 12, wherein the segment ring is made of metal and the guiding and sealing band is made of plastic.

14. A cartridge according to claim 1, wherein the radial wall areas of the sabot cage are provided with pocket-shaped depressions at both a front and the rear of the radial wall areas.

15. A cartridge according to claim 1, wherein the sabot cage is comprised of three identical sabot cage segments.

16. A cartridge according to claim 1, wherein the segmented one-flange sabot cage is connected non-positively to the projectile body by a cone seat.

17. A cartridge according to claim 1, wherein the segmented one-flange sabot cage is connected positively to the projectile body by a groove profile or a thread.

* * * * *